United States Patent [19]

Freismuth et al.

[11] 3,962,379

[45] June 8, 1976

[54] CARBURETOR COLD ENRICHMENT SYSTEM HAVING AUTOMATIC CHOKE OPENER AND FAST IDLE CAM HIGH STEP PULLOFF APPARATUS

[75] Inventors: Richard J. Freismuth, Mount Clemens; Joseph F. Lopiccola, Warren, both of Mich.

[73] Assignee: Ford Motor Company, Dearborn, Mich.

[22] Filed: Sept. 30, 1975

[21] Appl. No.: 618,298

[52] U.S. Cl. ..... 261/39 B; 261/52; 123/119 F

[51] Int. Cl.² ..... F02M 1/10

[58] Field of Search ..... 261/52, 39 B, 39 A; 123/119 F

[56] References Cited

UNITED STATES PATENTS

| | | | |
|---|---|---|---|
| 2,815,942 | 12/1957 | Olson | 261/52 |
| 3,263,972 | 8/1966 | Braun et al. | 261/52 |
| 3,740,040 | 6/1973 | Brown et al. | 261/52 |
| 3,834,677 | 9/1974 | Hosho | 261/39 B |
| 3,886,241 | 5/1975 | Schubeck | 261/52 |
| 3,906,911 | 9/1975 | Nakada et al. | 261/52 |

*Primary Examiner*—Tim R. Miles

*Attorney, Agent, or Firm*—Robert E. McCollum; Keith L. Zerschling

[57] ABSTRACT

A carburetor has a vacuum servo that actuates a rotatable cam member to automatically rotate the fast idle cam off its high cam step engagement with the throttle valve adjustable idle stop screw while at the same time opening the choke valve to both lean the mixture and reduce mixture volume, for better emission control than when manually controlled as in conventional constructions.

4 Claims, 4 Drawing Figures

Figure 1:
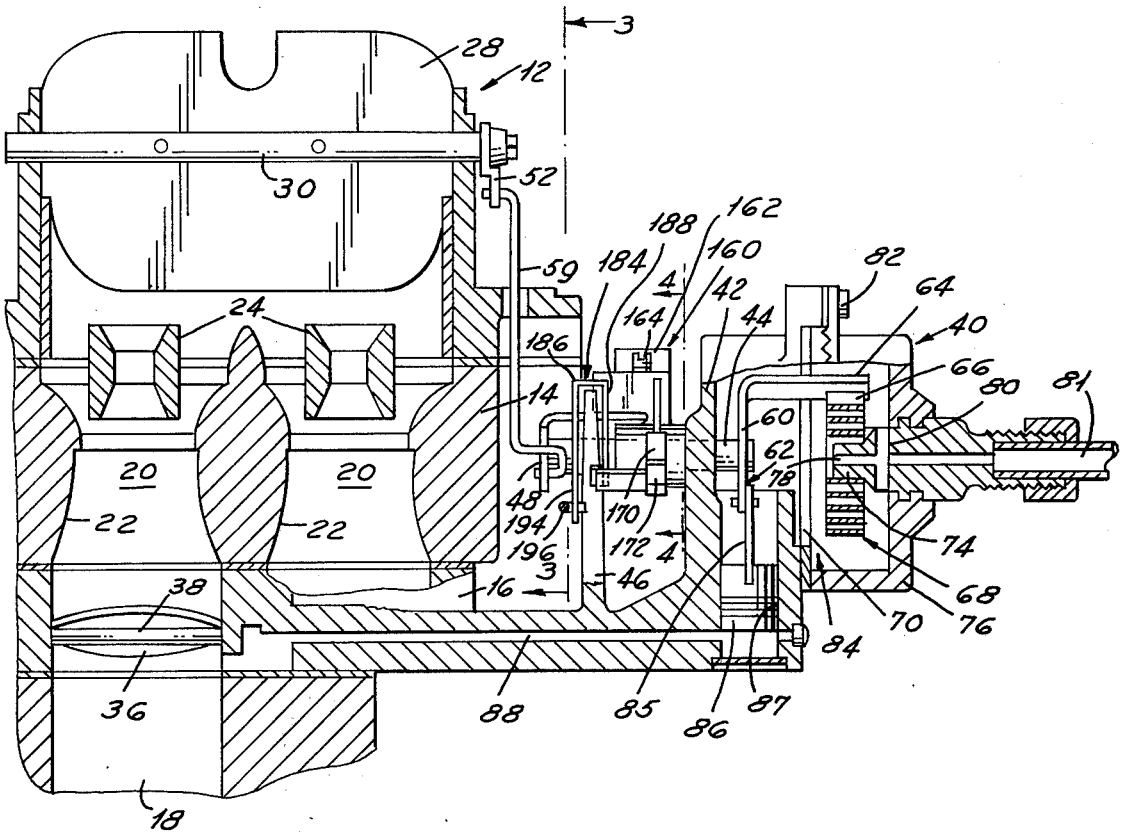

CARBURETOR COLD ENRICHMENT SYSTEM HAVING AUTOMATIC CHOKE OPENER AND FAST IDLE CAM HIGH STEP PULLOFF APPARATUS

This invention relates in general to a motor vehicle type carburetor having a choke valve and a fast idle cam. More particularly, it relates to a construction for automatically opening the choke valve and simultaneously rotating the fast idle cam to move the high cam step out of engagement with the throttle valve stop.

Most conventional carburetors have an automatic choke system for restricting air intake to richen the carburetor air/fuel mixture during cold engine operation to maintain good engine driveability. Also, in most instances, a fast idle cam that is operably rotated by a thermostatically responsive coiled spring is positioned in the path of closing movement of the throttle vavle to maintain it more open than the normal engine idle speed position to allow enough extra fuel/air mixture into the engine to sustain cold engine operation. The thermostatic spring also urges the choke valve towards a closed position for engine starting, and immediately after the engine has reached a sustained operation, a pulldown servo cracks open the choke valve to a position leaning the air/fuel mixture to prevent rich mixture stalling.

In the above construction, an adjustable screw secured to the throttle valve rotates into frictional engagement with a high cam step on the fast idle cam to determine the cold engine idle speed position of the throttle vavle. Until the vehicle operator, therefore, manually opens the throttle valve to release the cam, it cannot move from its position because of the frictional resistance. Therefore, the throttle valve will remain in a fast idle position with a higher than required engine speed as the engine begins to warm up. The normal procedure then is for the operator to depress the accelerator pedal to back off the idle screw from the fast idle cam face and permit the cam to fall by gravity to whatever position is dictated by the particular temperature conditions. Subsequent release of the accelerator pedal then will reengage the fast idle screw with a lower step face of the cam and permit a closing down of the throttle valve.

It is a primary object of the invention, therefore, to provide an apparatus for automatically rotating the fast idle cam off its high cam step engagement with the throttle valve screw to decrease engine speed to a level more consistent with engine operational requirements, while at the same time opening the choke valve to lean the air/fuel mixture to a level more agreeable with the new throttle valve setting.

It is a further object of the invention to provide a carburetor of the type described above with a vacuum servo mechanism actuated by engine intake manifold vacuum to rotate a camming member against the fast idle cam to rotate it so that the high cam step will be moved out of engagement with the throttle valve idle adjustment screw and a second lower cam step of less radial extent will be rotated into engagement with the idle adjustment screw, the rotation of the fast idle cam also engaging a lever connected to the choke valve to concurrently move the choke valve to a more open position.

It is a still further object of the invention to provide a carburetor of the above construction in which communication of intake manifold vacuum to the servo is delayed long enough after the engine has been started to assure sufficient engine rpm buildup before automatic high cam step pulloff and choke opening occurs, to prevent engine stalling.

It is also an object of the invention to provide a carburetor of the construction described above that includes a thermostatically responsive coiled spring normally urging the choke valve towards a closed position in response to temperature levels decreasing below the normal engine operating temperature, and a second vacuum servo actuated in response to engine starting operation to initially crack open the choke valve a predetermined amount sufficient to prevent engine stalling once the engine has been started.

Figure 3:
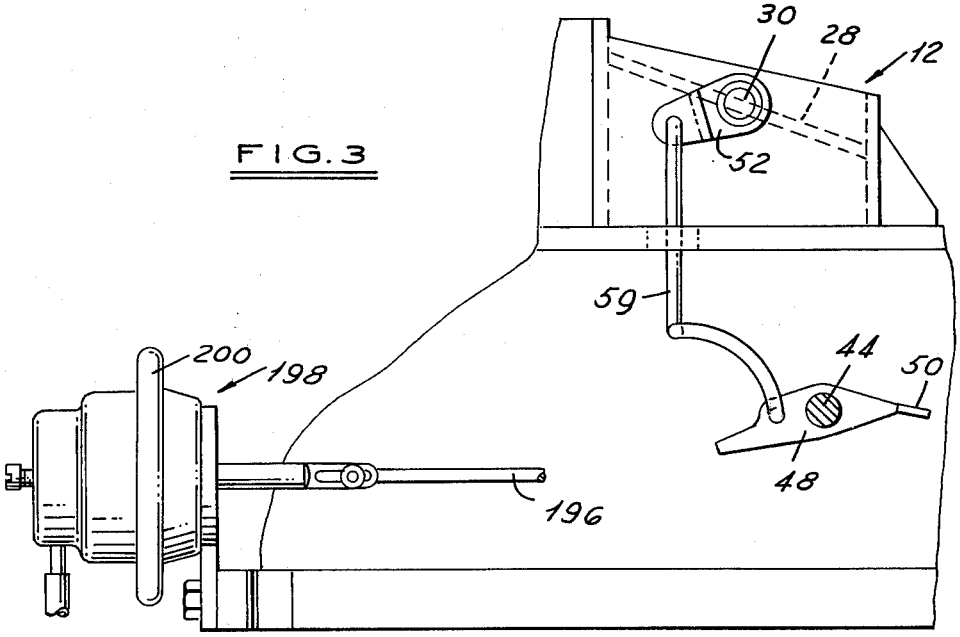
Figure 2:
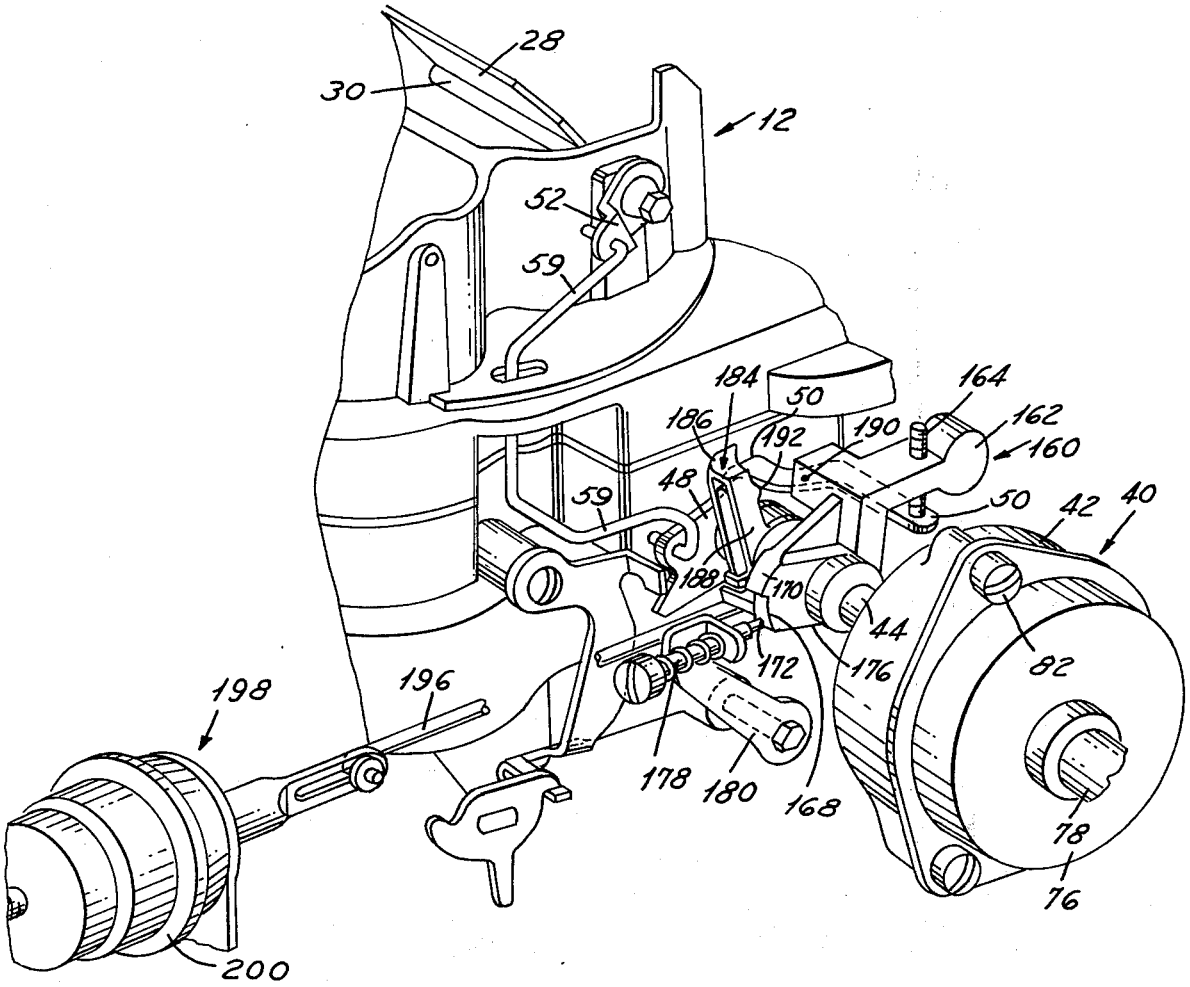
Figure 4:
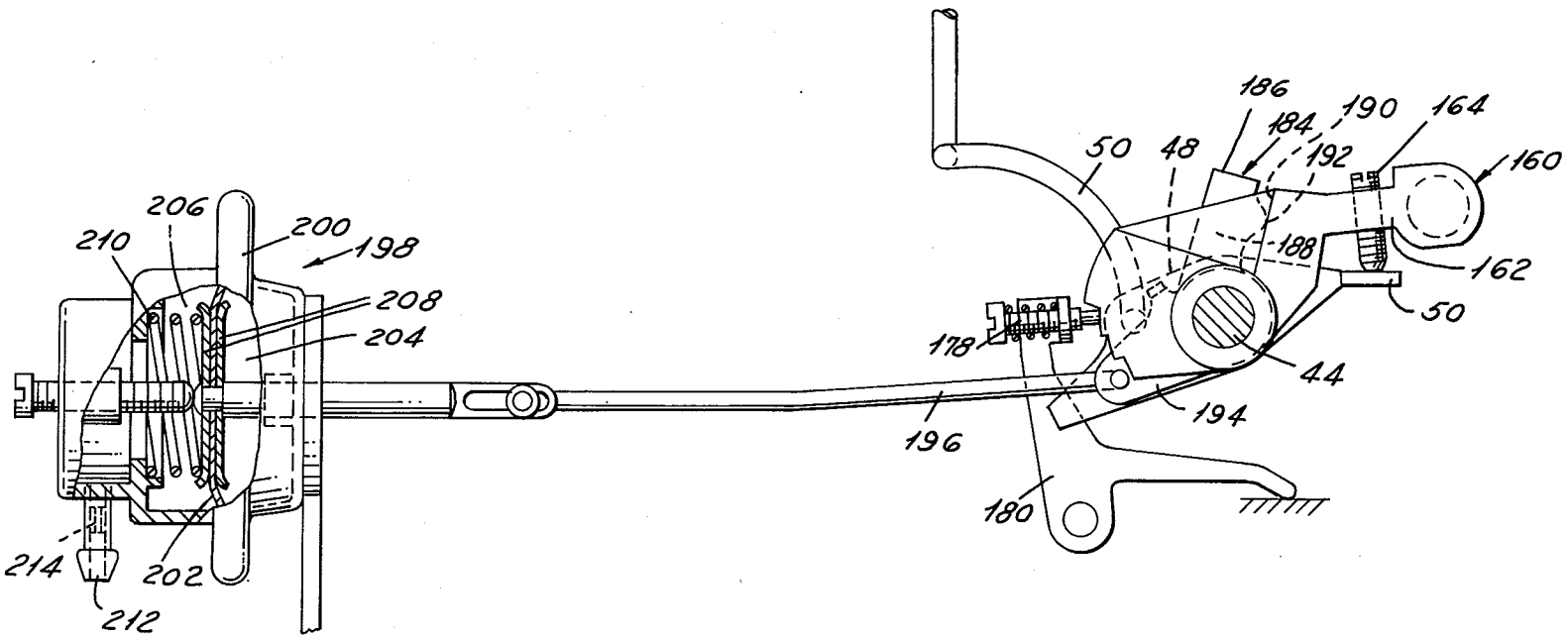

Other objects, features and advantages of the invention will become more apparent upon reference to the succeeding detailed description thereof, and to the drawings illustrating the preferred embodiment thereof, wherein:

FIG. 1 is a cross-sectional view of a portion of a carburetor embodying the invention;

FIG. 2 is a perspective elevational view of the carburetor shown in FIG. 1; and, FIGS. 3 and 4 are side elevational views, with parts broken away and in section, of portions of the FIG. 2 showing taken on planes indicated by and viewed in the direction of the arrows 3—3 and 4—4 of FIG. 1.

FIG. 1 is obtained by passing a plane through approximately one-half of a known type of two-barrel, downdraft carburetor. It includes an air horn section 12, a main body portion 14, and a throttle body 16 secured together by suitable means, not shown, over an intake manifold indicated partially at 18 leading to the engine combustion chambers.

Main body portion 14 contains the usual air/fuel mixture induction passages 20 having fresh air intakes at the air horn ends, and connected to manifold 18 at the opposite ends. The passages are each formed with a main venturi section 22 in which is suitably mounted a boost venturi 24.

Air flow into passages 20 is controlled by a choke valve 28 that is unbalance mounted on a shaft 30. The shaft is rotatably mounted in side portions of the carburetor air horn, as shown. Flow of the usual fuel and air mixture through each passage 20 is controlled by a conventional throttle valve 36 fixed on a shaft 38 rotatably mounted in the throttle body 16. The throttle valves are rotated in the usual manner by depression of the vehicle accelerator pedal, and move from idle speed or closed positions to positions essentially at right angles to that shown.

Choke valve 28 also rotates from a closed position to the nearly vertical, essentially inoperative position shown. In this latter position, the choke valve provides the minimum obstruction to airflow. The rotative position of choke valve 28 is controlled in part by a semiautomatically operating choke mechanism 40. The latter includes a hollow housing portion 42 that is cast as an integral extension of the carburetor throttle body 16. The housing is apertured for rotatably supporting one end of a choke valve control shaft 44, the other end being rotatably mounted in a support post 46. A bellcrank-type lever 48 fixed on the left end portion of shaft 44 is pivotally connected by a link 59 to a lever 52 fixed on choke valve shaft 30. It will be clear that rotation of shaft 44 in either direction as seen in FIG. 3 will rotate choke valve 28 in a corresponding direction to open or close the carburetor air intake, as the case may be.

The end of shaft 44 in housing 42 has fixed on it one leg 60 of an essentially L-shaped thermostatic spring lever 62. The other lever leg portion 64 is secured to the end 66 of a thermostatically responsive, bimetallic, coiled spring element 68 through an arcuate slot, not shown, in an insulating gasket 70. The inner end portion of the coiled spring is fixedly secured on the end of a nipple 74 formed as an integral portion of a choke cap 76 of heat insulating material. Nipple 74 is bored as shown to provide hot air passages 78 and 80 connected to an exhaust manifold heat stove, for example, by a tube 81. Cap 76 is secured to housing 42 by suitable means, such as the screw 82 shown, and defines an air or fluid chamber 84.

As thus far described, it will be clear that the thermostatic spring element 68 will contract or expand as a function of changes in temperature of the air entering tube 81, or, if there is no flow, the ambient temperature of the air within chamber 84. Accordingly, changes in temperature will rotate the spring lever 62 to rotate shaft 44 and lever 48 in one or the other directions, as the case may be.

The leg 60 of lever 64 is pivotally fixed to the rod 85 of a choke pulldown piston 86. The latter is movably mounted in a bore 87 in housing 42. The under surface of piston 86 is acted upon by vacuum in a passage 88 that is connected to one of the carburetor main induction passages 20 by a port 89 located just slightly below throttle valve 36. Piston 86, therefore, is always subject to the vacuum existing in the intake manifold passage portion 18.

The start of a cold engine requires a richer mixture than that of a warmed engine because less fuel is vaporized. Therefore, the choke valve must be shut or nearly shut to restrict air flow and increase the pressure drop across the fuel inlet to draw in more fuel and less air. Once the engine does start, however, then the choke valve should be opened slightly to lean the mixture to prevent engine flooding as a result of an excess of fuel.

The choke mechanism described above automatically accomplishes the action described. That is, on cold weather starts, the temperature of the air in chamber 84 will be low so that the outer end of spring element 68 will move circumferentially. This will rotate lever 48 in a counterclockwise direction to move choke valve 28 to a closed or nearly closed position, as desired. Upon cranking the engine, vacuum in passage 88 will not be sufficient to move piston 86 to open the choke valve. Accordingly, the engine will be started with a rich mixture. As soon as the engine is running, however, the higher vacuum level in passage 88 now moves piston 86 downwardly to rotate shaft 44, lever 48 and link 59 a slight amount sufficient to slightly open the choke valve to lean the mixture.

During cold engine operation, it is also necessary to open the throttle valve wider to allow enough extra air/fuel mixture into the engine to prevent it from stalling due to the extra friction, greater viscosity of the lubricant, etc. As best seen in FIGS. 1 and 2, rotatably mounted on shaft 44 is a conventional fast idle cam 160. The cam has a projection 162 on one side in which is adustably mounted a screw 164. The screw has a one-way engagement with a finger or tab 50 that is integral with and projects laterally from the choke lever 48. The fast idle cam projection 162 also contains a recess, not shown, in which is pressed a weight or ball of predetermined mass. The mass and its location is chosen such that the cam will always fall by gravity in a clockwise direction to follow the movement of tab 50 of lever 48. This will effect rotation of the fast idle cam clockwise progressively as the temperature of bimetal 68 increases.

The opposite side of cam 160 is formed with an edge 168 having two circumferentially contiguous steps, a high cam step 170, and a lower cam step 172. Each step in counterclockwise circumferential succession is defined by a face that is of less radial extent than the previous one, the lower step 172 being followed by an opening 176. The steps and opening constitute abutments or stops in the path of movement of a screw 178. The screw is adjustably mounted on a lever 180 fixed on throttle shaft 38. The radial depth of opening 176 is chosen such that when the fast idle cam is rotated to engage the screw 178 in the opening 176, the throttle valve shaft will have rotated the throttle valve to its normal engine operating temperature level idle speed position essentially closing the throttle valve. Engagement of the screw 178 with each of the steps 170 and 172 as the cam rotates upon temperature decreases, then will progressively locate the idle speed position of the throttle valve at a more open position.

As best seen in FIGS. 2 and 4, a U-shaped cam member 184 is rotatably mounted on shaft 44 in an inverted position, and assembled with the bottom cross-over portion 186 over the support post 46. This positions the leg 188 of the cam member next to and in circumferential alignment with a portion 190 projecting from the cam so that a nub 192 projecting from leg 188 can engage the fast idle cam and rotate it. The cam member 184 and cam projection 190 thus have a one-way type interconnection permitting rotation of the fast idle cam 160 in a high cam step kickdown direction by the cam member 184, or free rotation of the cam away from the cam member, and vice versa.

The lower portion 194 of cam member 184 that projects below shaft 44 is pivotally connected to a link 196 movable by a vacuum servo 198. More specifically, the servo is of a conventional construction having a hollow housing 200 separated by an annular flexible diaphragm 202 into an air chamber 204 and a vacuum, spring chamber 206. The air chamber is open to atmosphere through the opening through which link 196 projects into the housing. The link is fixed to diaphragm 202 by retainers 208, the retainer on the vacuum chamber side of diaphragm 202 serving as a seat for spring 210. The spring urges the cam member 184 to an inoperative position away from the fast idle cam 160. The vacuum chamber 206 is connected by a tube 212 to the engine intake manifold, at any convenient spot not shown, or at a point below the throttle valve 38. The tube 212 contains an orifice or flow restrictor 214 to provide a predetermined time delay of say 6–18 seconds, depending upon the installation, after the engine becomes self-sustaining after start-up, before the vacuum servo becomes operative to actuate the cam member.

In overall operation, below temperature levels of say 75°F., for example, the contraction of bimetallic coiled spring 68 will urge choke lever 48 in a counterclockwise direction. Depression of the accelerator pedal will pivot the throttle valve shaft 38 counterclockwise to move screw 178 away from the fast idle cam 160. This will permit the cam to be moved by the finger portion 50 of choke lever 48, which is urged counterclockwise by coiled spring 66 to the closed choke position. Release of the accelerator pedal then permits the screw to engage high cam step 170 that is opposite the screw at this time. This then locates the throttle valve for a fast idle throttle setting predetermining the volume of air/fuel mixture to flow into the engine during cold engine operation at this temperature.

Upon engine starting, engine vacuum is first applied to piston 86, the restriction in tube 212 delaying actuation of servo 198. This rotates choke shaft 44 and lever 48 a predetermined amount, moving finger portion 50 clockwise away from cam 160 to crack open the choke valve by the same degree. The cranking mixture then is leaned to a less rich mixture preventing stalls. Shortly after this operation, vacuum now fully applied to servo 198 pulls the link 196 leftwardly in FIG. 4 to rotate cam member 184 clockwise. In doing so, projection 192 engages cam projection 190 to rotate cam 160 progressively clockwise. This stroke of link 196 is such that the cam will rotate far enough clockwise to move the high cam step 170 away from engagement with the throttle lever stop screw 168, and into engagement with the lower cam step 172. At the same time, the clockwise rotation of cam 160 will cause it to catch up to the finger portion 50 of choke lever 48, and just slightly before or as the fast idle cam is "kicked down" off the high cam step, the further clockwise movement of the choke lever 48 will open the choke valve to a newer setting more compatible with the lower engine rpm throttle lever setting now attained.

Thus, it will be seen that the invention provides a mechanism that automatically "kicks down" the fast idle cam to a lower cam setting to reduce engine idle speed while at the same time opening wider the choke valve, thus eliminating the requirement of the driver to perform the kickdown operation, as conventionally must be done, and therefore, reducing emission output by providing better control of the combustion than when it is manually controlled. This lessens the emission of undesirable elements by leaning the mixture to the proper level.

While the invention has been shown and described in its preferred embodiment, it will be clear to those skilled in the arts to which it pertains that many changes and modifications may be made thereto without departing from the scope of the invention.

What is claimed:

1. A carburetor having an air/fuel induction passage open at one end to air at essentially atmospheric pressure and connected at its opposite end to an engine intake manifold to be subject to the changing vacuum levels therein, the one end having a choke valve rotatably mounted for movement across the passage between a closed air choking position and an open inoperative position, and a throttle valve rotatably mounted posterior of the choke valve for movement across the passage between a normal essentially closed engine idle speed position and beyond towards a wide open throttle position to control the quantity of air/fuel mixture flow through the passage, an abutment means rotatable with the throttle valve, a rotatable fast idle cam having a high cam step projecting radially from the cam axes for engagement at times by the abutment means during movement of the throttle valve in a closing direction to stop the throttle valve in a more open position than the idle speed position to increase mixture flow to the manifold, the cam also having a second cam step of lesser radial extent engagable with the abutment means at other times as a function of the rotative position of the cam to stop the throttle valve in a less open position than the high cam step position, the cam being rotatable by gravity towards an inoperative position upon disengagement of the abutment means with the cam steps permitting closure of the throttle valve to the normal idle speed position, rotatable lever means secured to the choke valve and having a portion extending into the path of rotative movement of the fast idle cam towards the inoperative position to stop the cam rotation, means to rotate the lever means, and vacuum mechanical control means operable during cold engine operations while the abutment means is engaged with the fast idle cam high step to automatically both open the choke valve and rotate the fast idle cam to a position disengaging the abutment means from the high cam step and engaging it with the second cam step to lean and reduce the mixture flow to the engine to improve emissions while minimizing engine stalling, the control means including a shaft, means rotatably mounting the fast idle cam and a cam member on the shaft, the cam member having a projecting portion having at times a unidirectional engagement with the cam to rotate the same towards its inoperative position, and a vacuum servo connected to the cam member and operable to rotate the cam member against the cam to rotate the same off the high cam step engagement with the abutment means and also engage and rotate the lever means projecting portion to open the choke valve.

2. A carburetor as in claim 1, including means securing the shaft to the lever means and to a thermostatically responsive spring means urging the shaft and lever means in a choke closing direction upon decreases in temperature below the normal engine operating temperature level to abut the lever means portion with the fast idle cam and permit repositioning of the fast idle cam to its high cam step engagement position with the abutment means for engine starting purposes.

3. A carburetor as in claim 1, including further means operable during engagement of the cam high step by the abutment means to initially rotate the lever portion away from the fast idle cam to open the choke valve, thereby permitting a subsequent delayed actuation of the lever portion by the fast idle cam upon operation of the vacuum servo.

4. A carburetor as in claim 3, the further means comprising a second vacuum servo rendered operable during engine starting and upon the engine reaching a running condition, a vacuum line connecting the engine intake manifold and the first-mentioned servo and delay means in the vacuum line to prevent operation of the first-mentioned servo prior to operation of the second servo.

* * * * *